US005946953A

United States Patent [19]

Feldpausch (incapacitated)

[11] Patent Number: 5,946,953

[45] Date of Patent: Sep. 7, 1999

[54] LOCKING SYSTEM FOR STORAGE CABINETS

[75] Inventor: Stephen J. Feldpausch (incapacitated), Hastings, Mich., by Kelly L. Feldpausch, Legal Representative

[73] Assignee: Steelcase Inc., Grand Rapids, Mich.

[21] Appl. No.: 09/055,840

[22] Filed: Apr. 6, 1998

[51] Int. Cl.[6] ..... E05B 65/44

[52] U.S. Cl. ..... 70/78; 70/85; 312/221; 312/219

[58] Field of Search ..... 70/77, 78, 81–86; 312/218, 219, 221

[56] References Cited

U.S. PATENT DOCUMENTS

| | | | |
|---|---|---|---|
| 410,378 | 9/1889 | Rodeheaver | 70/85 |
| 921,895 | 5/1909 | Sampson | 70/85 |
| 970,933 | 9/1910 | Leese | 312/219 |
| 970,934 | 9/1910 | Leese | 70/86 X |
| 1,174,652 | 3/1916 | Banks | 292/36 |
| 1,318,011 | 10/1919 | Schiavone | 312/219 |
| 1,847,106 | 3/1932 | Turner | 312/219 X |
| 2,091,382 | 8/1937 | Swimmer | 292/182 X |
| 2,094,895 | 10/1937 | Karpenske et al. | 312/219 X |
| 2,202,088 | 5/1940 | Clark | 312/219 X |
| 2,225,243 | 12/1940 | Zottel | 70/85 X |
| 2,747,960 | 5/1956 | Ambrosino | 312/219 |
| 2,930,666 | 3/1960 | Ibel | 312/218 |
| 3,297,376 | 1/1967 | Barstow | 312/219 |
| 3,497,280 | 2/1970 | Olree et al. | 312/219 |
| 3,511,549 | 5/1970 | Macaluso | 312/219 |
| 3,539,236 | 11/1970 | Miller | 312/221 |
| 3,764,190 | 10/1973 | Anderson | 312/286 |
| 3,767,280 | 10/1973 | McLaughlin | 312/219 |
| 3,776,007 | 12/1973 | Himsl | 70/86 |
| 3,834,780 | 9/1974 | McClellan et al. | 312/219 |
| 4,239,309 | 12/1980 | De Fouw et al. | 312/221 |
| 4,246,769 | 1/1981 | McLaughlin | 70/85 |
| 4,441,767 | 4/1984 | Stark | 312/216 |
| 4,453,787 | 6/1984 | Staropoli | 312/215 |
| 4,609,233 | 9/1986 | Walla | 312/219 |
| 4,637,667 | 1/1987 | Reid et al. | 312/217 |
| 4,662,689 | 5/1987 | Chatterson et al. | 312/219 |
| 4,721,347 | 1/1988 | Kritselis | 312/219 |
| 4,865,404 | 9/1989 | Harper | 312/221 |
| 5,184,887 | 2/1993 | O'Keefe et al. | 312/221 |
| 5,257,860 | 11/1993 | Slivon | 312/218 |
| 5,385,039 | 1/1995 | Feldspausch et al. | 70/78 |
| 5,595,076 | 1/1997 | Weinerman et al. | 70/208 |
| 5,661,991 | 9/1997 | Hsu | 70/312 |
| 5,709,442 | 1/1998 | Feldpausch et al. | 312/221 |

*Primary Examiner*—Suzanne Dino Barrett
*Attorney, Agent, or Firm*—Foley & Lardner

[57] ABSTRACT

A storage cabinet is disclosed having a frame and a drawer movable with respect to the frame and a locking system. The locking system includes an input device having an output link movable along a path between a raised position and a lowered position and a lock blade (or coupling link) coupled to the output link of the input device, an output end and a fulcrum point. The locking system also has a lockbar coupled to the lock blade, a first locking element associated with the lockbar, and a second locking element associated with the drawer to be engaged by the first locking element. When the input device drives the output link to the raised position, the input end of the lock blade is raised and the lock blade pivots about the fulcrum point so that the output end of the lock blade is lowered and the lockbar disengages the first locking element from the second locking element. When the input device drives the output link to the lowered position, the input end of the lock blade is lowered and the lock blade pivots about the fulcrum point so that the output end of the lock blade is raised and the lockbar engages the first locking element with the second locking element. The locking system may include a pair of lockbars, each lockbar coupled to a coupling link. A pivot point for the fulcrum point of each coupling link is associated with the frame.

22 Claims, 5 Drawing Sheets

100
110
112
114
120
122
124
125
128
130
133
134
136
142
144
148
150
152
12
14
18
20
22
24
30
40
44
10

18
12
40
36
14
116
152
110
140
112
114
114e
C
144
146
142
30
32
128
125
122
126
123a
123b
124
148
127
120

LOCKING SYSTEM FOR STORAGE CABINETS

FIELD OF THE INVENTION

The present invention relates to a locking system for drawers in storage cabinets.

BACKGROUND OF THE INVENTION

Storage or file cabinets typically include a frame and sliding drawers configured to contain and store materials (such as file folders, documents, office supplies, etc.) that can be extended from or retracted into the frame. Storage cabinets also typically include a locking system in order to secure such materials during storage. The locking system prevents the drawers from being "opened", i.e., wholly or partially extended from the frame of the storage cabinet.

Typical locking systems for storage cabinets include a lock mechanism (e.g. with a key-actuated tumbler) that actuates a relatively complex arrangement of links, bars, pivots, etc. and coacting locking elements serving to provide a "mechanical" lock for the drawers. Such known arrangements typically must translate, through a series of multiple points of sliding contact and transitions between rotational and translational movement, a rotational input provided at the lock mechanism into a linear locking action at the coacting locking elements. Typically, such known arrangements require lubrication for quiet and efficient operation, and may be relatively difficult to assemble and service (due to complexity).

Accordingly, it would be advantageous to have a locking system for a storage cabinet having a relatively easy to install arrangement and a minimal number of changes in direction between the input and the locking action. It would also be advantageous to have a locking system with a minimal number of parts that was relatively inexpensive to manufacture and service. It would further be advantageous to have a locking system that was relatively efficient with a consistent motion (i.e. travel) and low input torque requirement. It would further be advantageous to have a locking system that provided greater reliability and operated relatively quietly without requiring lubrication. It would further be advantageous to have a locking system that readily can accommodate storage cabinets of various widths, sizes and configurations.

SUMMARY OF THE INVENTION

The present invention relates to a storage cabinet including a frame and a drawer movable with respect to the frame. The storage cabinet also includes a locking system with an input device having an output link movable along a path between a raised position and a lowered position and a lock blade having an input end coupled to the output link of the input device, an output end and a fulcrum point between the input end and the output end. The locking system has a lockbar with an input end coupled to the output end of the lock blade and an output end, a first locking element associated with the output end of the lockbar, and a second locking element associated with the drawer and adapted to be engaged by the first locking element. When the input device drives the output link to the raised position, the input end of the lock blade is raised and the lock blade pivots about the fulcrum point so that the output end of the lock blade is lowered and the lockbar is lowered to disengage the first locking element from the second locking element and when the input device drives the output link to the lowered position, the input end of the lock blade is lowered and the lock blade pivots about the fulcrum point so that the output end of the lock blade is raised and the lockbar is raised to engage the first locking element with the second locking element.

The present invention also relates to a locking system for a storage cabinet having a frame and at least one drawer movable with respect to the frame, including an input device and a pair of coupling links, each coupling link having an input end coupled to the input device, an output end, and a fulcrum point located between the input end and the output end. The locking system includes a pair of lockbars, each lockbar having an input and end coupled to the output end of the corresponding coupling link, a pair of first locking elements, each first locking element coupled to the corresponding lockbar and a pair of second locking elements, each second locking elements mounted to the at least one drawer. A pair of pivot points corresponding to each fulcrum point of each coupling link is associated with the frame.

DETAILED DESCRIPTION OF THE PREFERRED EMBODIMENTS

Figures 1, 2, 6, 8:
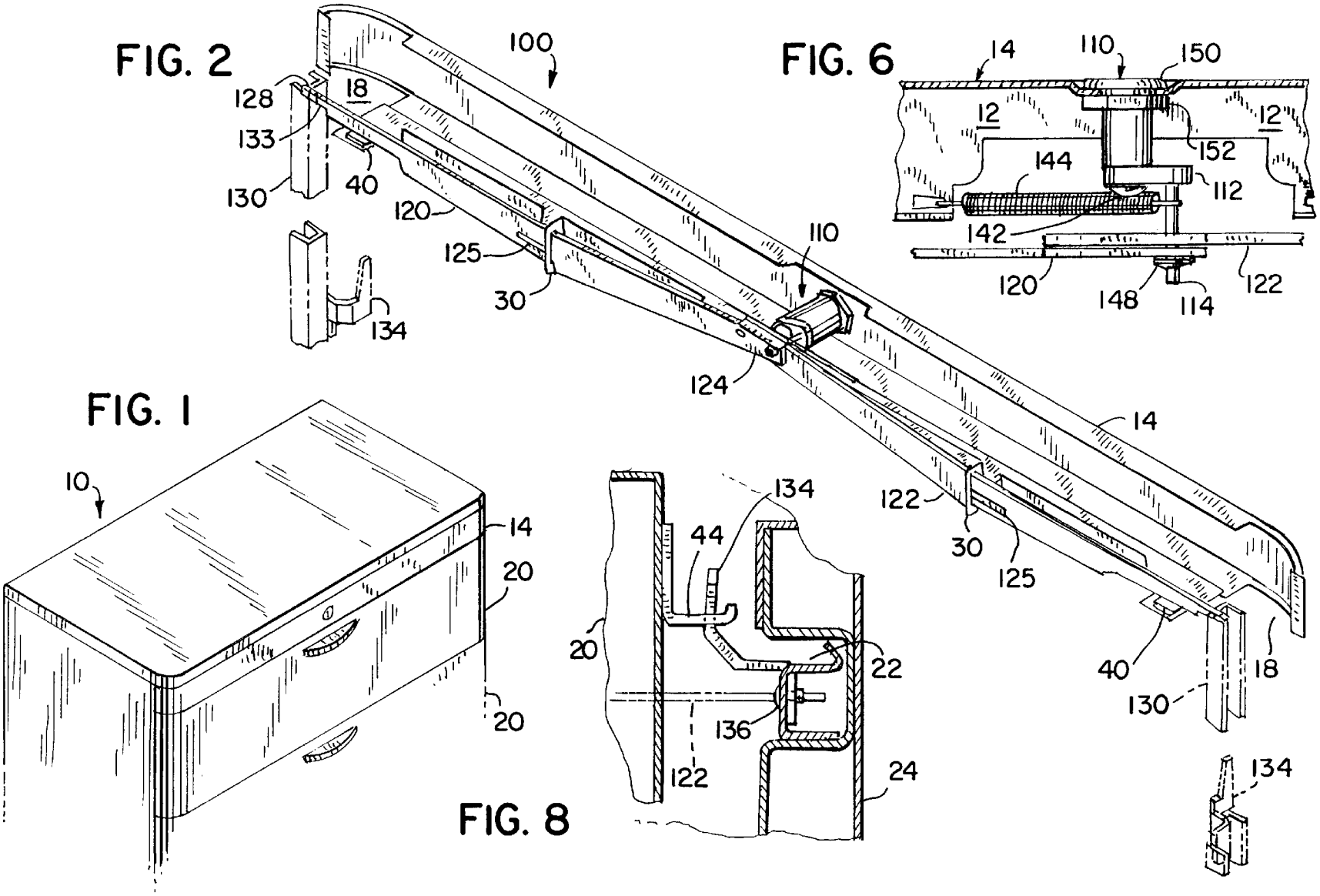
FIG. 1 is a fragmentary perspective view of a storage cabinet.
FIG. 2 is a fragmentary rear perspective of the storage cabinet showing a locking system.
FIG. 6 is a top plan view of a locking mechanism of the locking system.
FIG. 8 is a fragmentary sectional top plan view of a locking point of the locking system.

Referring to the FIGURES, shown are exemplary embodiments of a locking system 100 configured for use in a storage cabinet 10. Storage cabinet 10 (e.g. a file cabinet shown partially in FIG. 1) includes a frame 12 having a header 14, within which is installed an input device shown as a lock mechanism 110 (e.g. lock barrel assembly). As shown in FIGS. 1 and 2, header 14 is installed at the top and front of frame 12. Storage cabinet 10 also includes drawers 20 which are slidably movable from frame 12 between an extended position and a retracted position.

As shown in FIG. 2, lock mechanism 110, which is mounted to header 14, includes a lock cam 112 and a lock cam pin 114 (shown more clearly in FIG. 6). Rotation of a key 116 (shown in FIG. 3) within lock mechanism 110 rotates lock cam 112 (about a common center axis C). Lock cam pin 114 is mounted to lock cam 112 in an "off center" arrangement (i.e., extending axially in a direction parallel to the center axis of lock mechanism 110) so that rotation of lock cam 112 provides an arcuate motion of lock cam pin 114 with respect to center axis C of lock mechanism 110.

Locking system 100 includes a pair of coupled links shown as generally horizontal lock blades 120 and 122, each having a linked end 124 (or input end), a distal end 128 (or output end) and a fulcrum point 126. Linked end 124 of each of lock blades 120 and 122 is provided with a set of apertures shown as an inner slot 123*a* and an outer slot 123*b* for linking to lock cam pin 114 (through one of the apertures.) As shown in the FIGURES, linked ends 124 of lock blades 120 and 122 are thereby engaged by lock cam pin 114 and coupled to lock mechanism 110 for rotational and translational motion with lock cam 112. As in a preferred embodiment shown in FIGS. 3 through 5, an identical link can be used for both of lock blades 120 and 122 (e.g. right and left). As indicated in FIG. 3, with the apertures at the linked end of each lock blade (configured to receive the lock cam pin in any of a variety of linked combinations), different widths of the storage cabinet, or three different locations of the lock mechanism may be accommodated with identical lock blades.

A pair of vertical lockbars 130 are installed within 15 left and right jambs 18 of frame 12; each lockbar 130 includes a locking element (shown as a projecting hook 134 secured by a screw 160). Each lockbar 130 has near its upper end 132 (or "input" end) an aperture 133 by which it is suspended from distal end 128 of the corresponding lock blade. Lockbars 130 20 are thereby coupled to lock blades 120 and 122 for vertical movement (within jambs 18) with distal ends 128 of lock blades 120 and 122, in response to rotation of key 116 within lock mechanism 110. As shown in FIG. 8, lockbar 130 can be provided with a vertical guide shown as a channel 22 formed in the interior of wall 24 of storage cabinet 10.

Figures 3, 7:
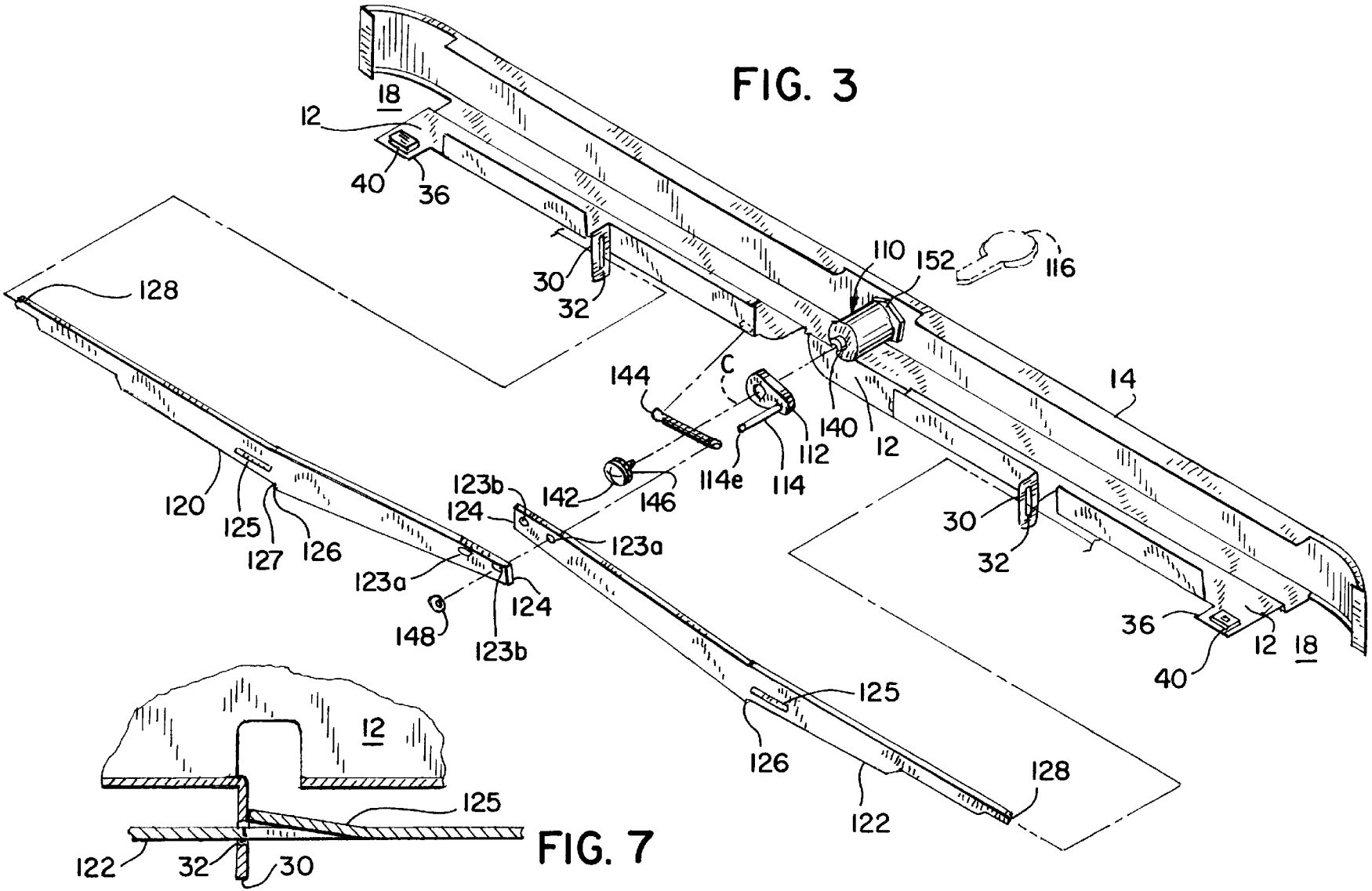
FIG. 3 is an exploded rear perspective view of the locking system.
FIG. 7 is a fragmentary sectional top plan view of a lock blade of the locking system.

Referring to FIG. 3, according to a preferred embodiment, header 14 of frame 12 is shown, including pivot brackets 30 with integral retaining slots 32 and fulcrums 34 (e.g., pivot points for the fulcrum points of the lock blades). Frame 12 is provided with bearing pads 40 (e.g., rubber cushions or "stops") at bearing or support areas where the surface of lock blades 120 and 122 may otherwise be in direct contact with frame 12; bearing pads 40 are supported by frame 12 (e.g., at formed flats 36 or tabs) and provide additional support for lock blades 120 and 122 and are intended to reduce noise (bounce or chatter) during operation of locking system 100.

As shown in FIG. 3, lock mechanism 110 is installed onto header 14 by fitting within an opening and being "clamped" onto a peripheral surface of an opening (not visible) on header 14 (between a front flange 150 and a nut 152). Lock cam 112 is secured to an axial shaft 140 of lock mechanism 110; the rotational position of the axial shaft 140 corresponds to that of a key 116 (i.e. both share common central axis C of lock mechanism 110). Referring to FIGS. 3 and 6, lock cam 112 is secured to axial shaft 140 by a fastener shown as a screw 142 provided with or including a locking fastener 146 (e.g. including an integrated or separate "star" washer or the like) Lock cam pin 114 is mounted to lock cam 112 (e.g. by molding, threaded connection, welding, or the like) and is configured to move in an arcuate path about central axis C of lock mechanism 110 when key 116 is turned within lock mechanism 110. According to a particularly preferred embodiment, linked ends 124 of lock blades 120 and 122 are each coupled to lock cam pin 114 through apertures shown as slots 123*a* and 123*b* within which a projecting end 114*e* of lock cam pin 114 is fitted and secured with a retaining fastener shown as a "Tinnerman" washer 148 (or a locking fastener or washer). (According to alternative embodiments, the input device may be linked to the lock blades by other suitable fastening arrangements.) A biasing device (or tensioning member) shown as an extension coil spring 144 is fit over lock cam pin 114 (at one end) and secured at a slot on frame 12 of header 14 (at the other end) to provide a biasing force intended to "drive" (i.e. assist) lock mechanism 110 past or over center either from the "locked" position to the "unlocked" position or from the "unlocked" position to the "locked" position. (This tends to hold the lock mechanism in either the locked or unlocked position; it also promotes a tactile over center "feel" for the operator.) Each drawer 20 includes a locking element shown in FIGS. 4 and 5 as a bracket 44 mounted on a sidewall 42 of drawer 20. According to an alternative embodiment shown in FIGS. 10 and 11, the locking element is an aperture 42*a* in the base of drawer 20. A locking element shown as projecting hook 134 is mounted to lockbar 130 by a fastener (shown as screw 160, according to a preferred embodiment). Each "locking point" of the locking system thereby includes coacting locking elements associated with each drawer and with the lockbar. As is evident from the FIGURES, each drawer is typically secured at two locking points, one at (or near) each lateral end or side of the drawer. According to alternative embodiments, other types of locking points could be employed within the locking system.

Figure 4:
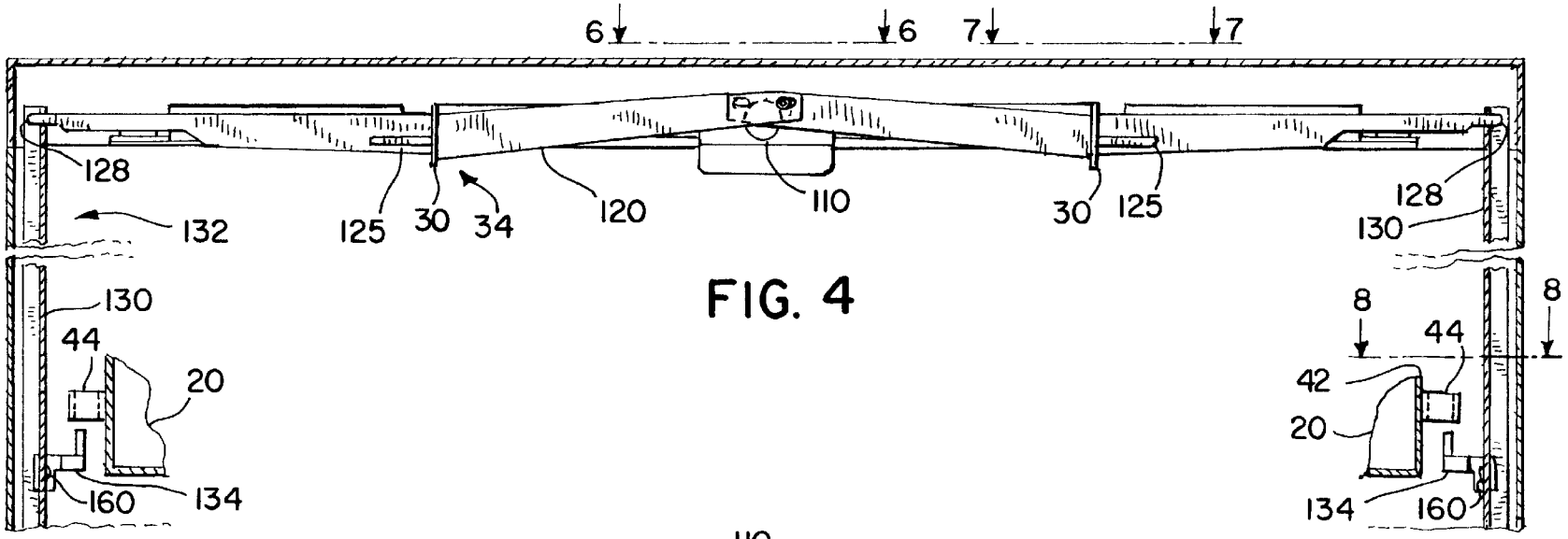
FIGS. 4 and 5 are a rear elevation views of the locking system (also showing locking elements associated with a drawer) in a disengaged (or unlocked) position and an engaged (or locked) position.
Figure 5:
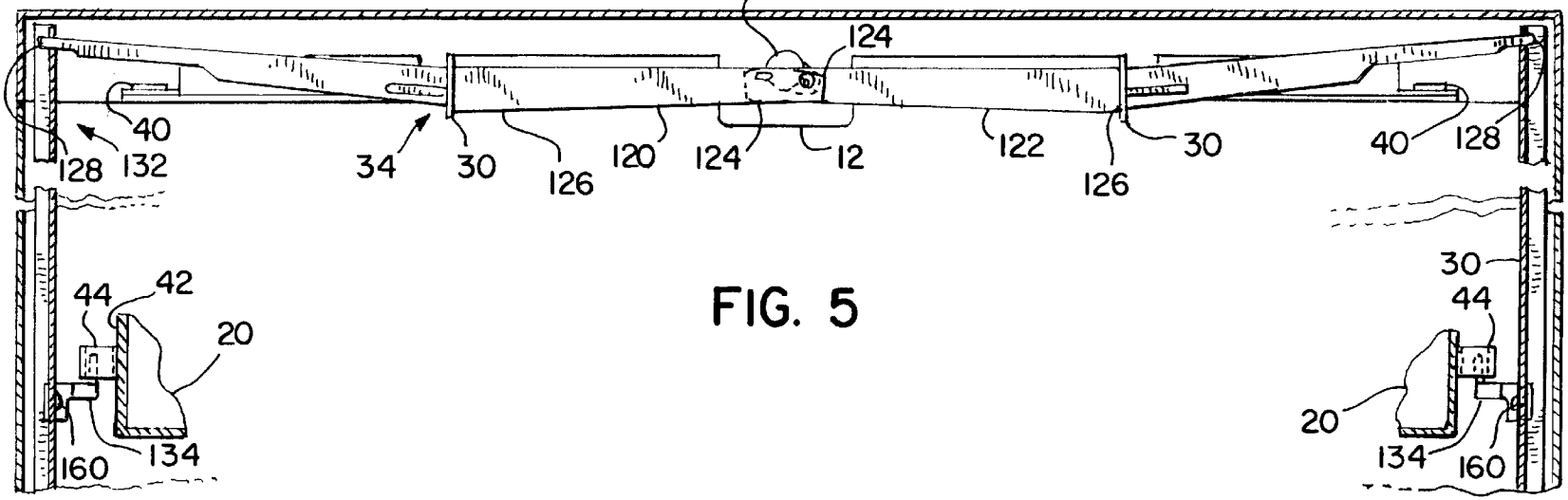
Figure 9:
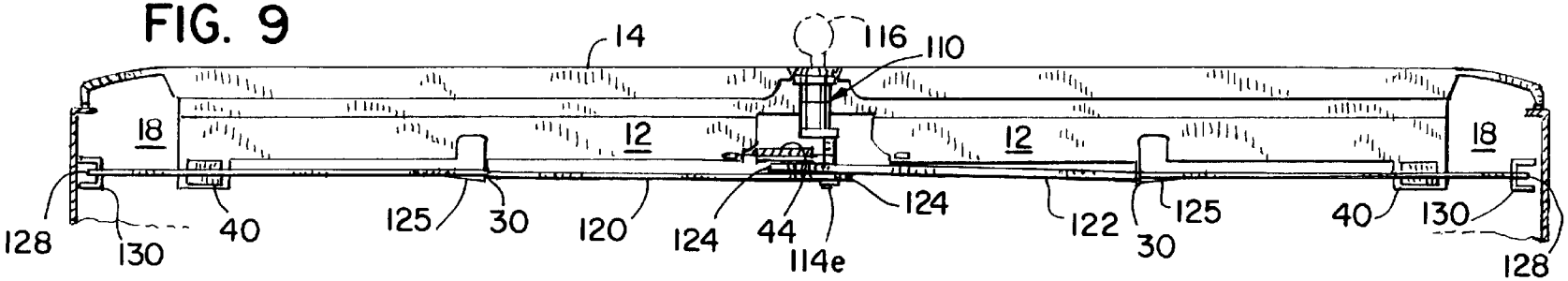
FIG. 9 is a top plan view of the locking system.

According to any preferred embodiment, as shown in FIGS. 4 and 5 (and FIGS. 10 and 11), lock mechanism 110 provides a "locked" input position and an "unlocked" input position according to the rotation of key 116 of lock mechanism 110. As shown in FIGS. 4 and 5, lock cam pin 114 of lock mechanism 110 rotates between a "raised" position (corresponding to an "unlocked" condition) and a "lowered" position (corresponding to an "locked" condition). Lock blades 120 and 122 function as levers at fulcrum points 126 to "lock" or "unlock" the storage cabinet: Rotation of key 116 within lock mechanism 110 between the "locked" input position and the "unlocked" input position drives distal end 128 of each of lock blades 120 and 122 from a corresponding "locked" output position (where lockbars 130 are raised) to an "unlocked" output position (where lockbars 130 are lowered). As is apparent, the "locked" position or "unlocked" position is given with reference to the drawer within the frame (while one drawer is shown in detail in the FIGURES it should be recognized that several drawers could be incorporated into the locking system according to alternative embodiments). According to alternative embodiments, the "locked" position and "unlocked" position could be reversed (e.g. the locking elements could be inverted so that a raised lockbar unlocks the drawer and a lowered lockbar locks the drawer).

FIG. 4 shows locking system 100 in an "unlocked" position; FIG. 5 shows locking system 100 in a "locked" position. In FIG. 4, lock cam 112 has been rotated to an unlocked position wherein lock cam pin 114 has been raised. Linked ends 124 of lock blades 120 and 122 (coupled to lock cam pin 114) have been raised; distal ends 128 of lock blades 120 and 122 (acting pivotally across fulcrums 34 of pivot brackets 30) have been lowered. Lockbars 130, coupled to distal ends 128 of lock blades 120 and 122, therefore have been lowered as well; coacting locking elements (134 and 44) have been disengaged. Drawer 20 is therefore "unlocked" in FIG. 4, and may be freely extended from frame 12 of storage cabinet 10.

In FIG. 5 lock cam 112 has been rotated to a "locked" position; lock blades 120 and 122 and lockbars 130 have been raised. Coacting locking elements (134 and 44) have been drawn into engagement as to prevent drawer 20 from being extended from frame 12 of storage cabinet 10. In FIG. 5, drawer 20 is therefore locked to frame 12.

According to the exemplary embodiments shown in the FIGURES, lock blades 120 and 122 are provided with a profile that tapers from a maximum width at fulcrum point 126 to a somewhat narrower width at linked end 124 and a staged narrowing width approaching distal end 128. As shown, distal end 128 is configured (e.g. sized and shaped) to fit within corresponding slot 133 at upper end 132 of lockbar 130 so that each of lock blades 120 and 122 remain engaged with each lockbar 130 during operation (and for ease and efficiency of assembly). According to a particularly preferred embodiment, during assembly (i.e. installation of the locking system), distal ends 128 of lock blades 120 and 122 are inserted through retaining slots 32 in pivot brackets 30 of frame 12 (in the directions shown in broken lines in FIG. 3). A stop (shown in FIG. 7 as a tab lock 125) on each of lock blades 120 and 122 deflects inwardly as lock blades 120 and 122 are inserted within retaining slots 32 in pivot brackets 30, then "snaps" back in order to retain lock blades 120 and 122 within the frame of header 14. A notch 127 on each of lock blades 120 and 122 shown at or near fulcrum point 126 provides an "index" during assembly and tends to keep lock blades 120 and 122 in alignment (since lock cam pin 114 fits within slots 123*a* and 123*b* and thus some degree of travel will occur). It is important to note that according to any preferred embodiment, the lock blades can be modified in a wide variety of configurations and profiles in order to fit design constraints imposed by the frame of the header and the storage cabinet.

Figure 10:
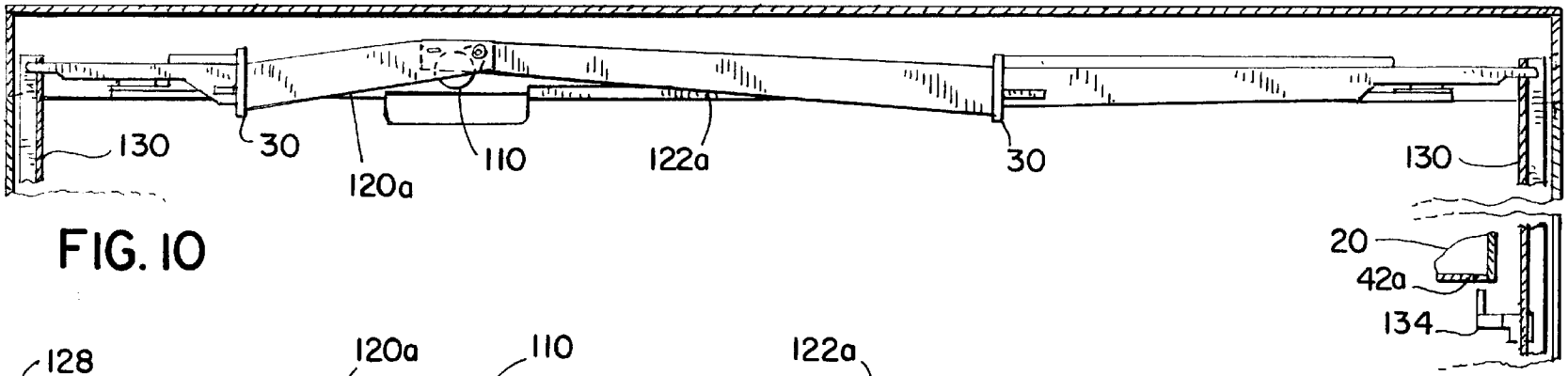
FIGS. 10 and 11 are a rear elevation views of a locking system according to an alternate embodiment (also showing locking elements associated with a drawer) in a disengaged (or unlocked) position and an engaged (or locked) position.
Figure 11:
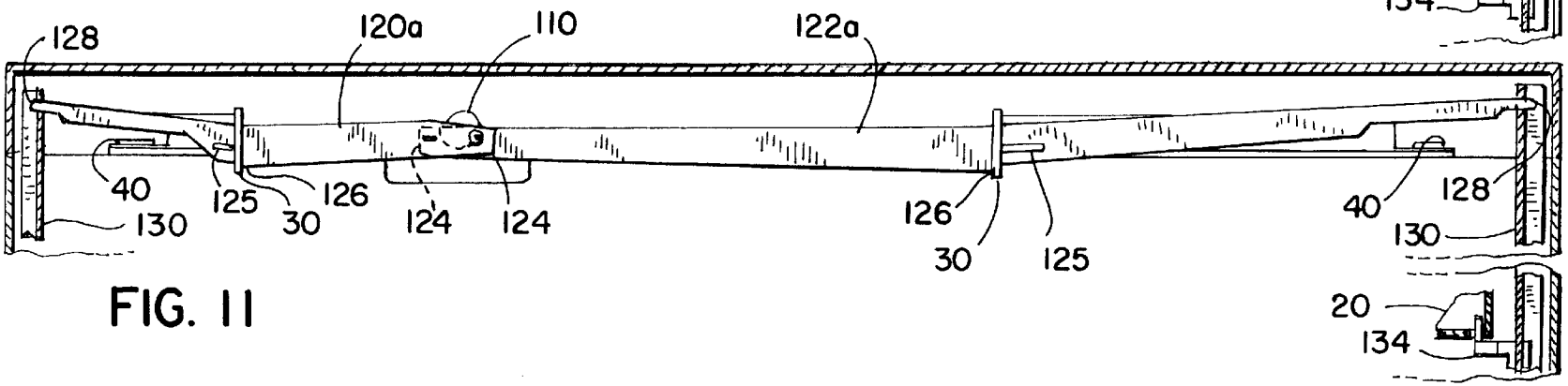

According to any particularly preferred embodiment, the lock blades are identical in shape and size (preferably formed from a metal sheet). According to alternative embodiments, as shown in FIGS. 10 and 11, each of lock blades 120*a* and 122*a* may be of a differing size, nevertheless providing the requisite locking action at the locking points so that the input device can be repositioned accordingly upon the front of header 14 (i.e. moved "off center"). Fulcrums 34 and associated pivot brackets 30 are correspondingly repositioned within frame 12 so that the lock blades 120*a* and 122*a* operate cooperatively, i.e. so that each lockbar 130 is raised or lowered the desired distance upon rotation of key 116 within lock mechanism. According to any preferred embodiment, the ratio of lever arm lengths of the lock blades are matched so that the vertical movement of each lockbar upon rotation of the key within the lock mechanism is equal, or at least suitable, to effect the required locking action. (Note that according to a preferred embodiment, as in FIG. 6, lock cam pin 114 is itself "off center" i.e. disposed to one side of the center line C of lock mechanism 110, and therefore lock blades 120 and 122 each travel slightly different distances.)

Figure 12:
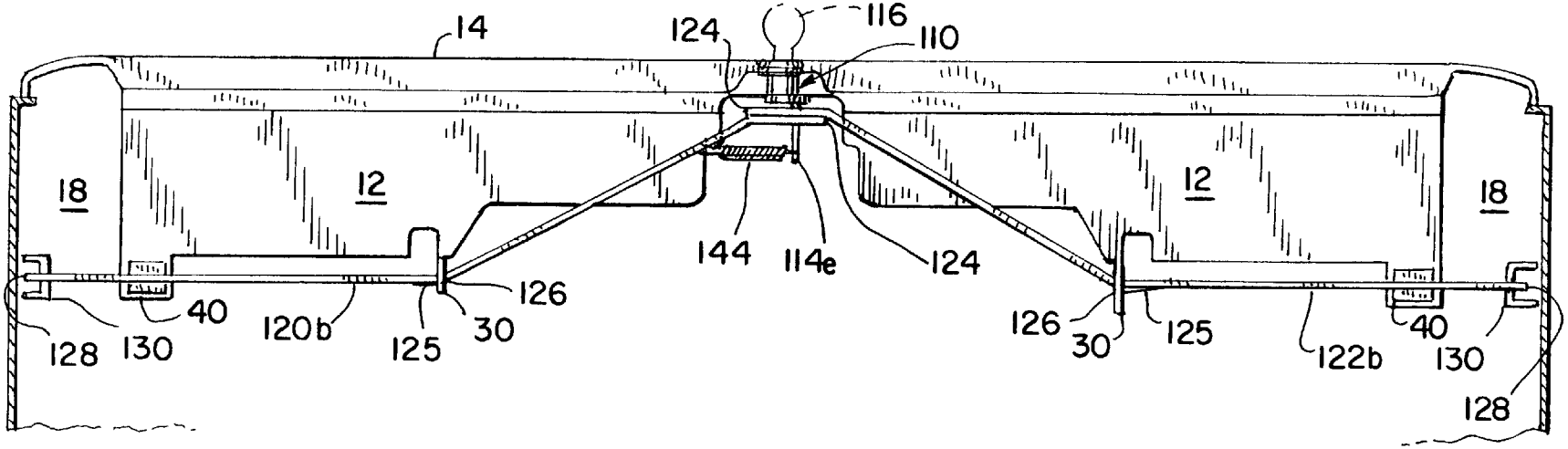
FIG. 12 is a top plan view of a locking system according to an alternative embodiment.

According to a particularly preferred embodiment, such as shown in FIGS. 1 through 11, the lock blades have a flat profile (and the lockbars and lock mechanism are generally within the same vertical plane). According to alternative embodiments, such as shown in FIG. 12, lock blades 120*b* and 122*b* are formed with an offset shape so that lockbars 130 (and corresponding locking elements (134 and 44) can be located in a different vertical plane within the body of storage cabinet 10 than is lock mechanism 110.

According to alternative embodiments, the locking points can be configured in any arrangement known to those of ordinary skill who may review this disclosure that is capable of effecting a locking and unlocking action based on the motion provided at the output end of the coupled links (e.g. lock blades). It is also important to note that according to alternative embodiments (that would be apparent to those of ordinary skill who have reviewed this disclosure), the locking system, and particularly the lock blades could be configured to provide locking action at or accommodate the constraints imposed by a wide variety of types and designs of locking points.

Although only a few exemplary embodiments of the present invention have been described in detail, those skilled in the art who review this disclosure will readily appreciate that many modifications are possible in the exemplary embodiments without materially departing from the novel teachings and advantages of this invention. For example, distance of travel of the lockbars and torque upon the key may be varied by changing the positions of the pivot brackets and hence of the fulcrums with respect to the lengths of the lock blades. The pivot brackets may be constructed separately and affixed to the header (e.g., by spot welding, riveting, or threaded fasteners). The locking system may be installed elsewhere within the frame, and the lock mechanism may likewise conveniently be mounted elsewhere upon the frame. A lock mechanism without a particular "home" position may be used and a biasing spring not provided (e.g. preferably if a mechanism or device is provided to retain or "hold" the locking system in the locked or unlocked position), or a stronger biasing spring may be provided. While a dual locking system is shown and described, having right and left lock blades and lockbars as well as related parts, either the right set or the left set may be eliminated and the storage cabinet locking system may be configured as a single-sided locking system.

Accordingly, all such modifications are intended to be included within the scope of the invention as defined in the following claims. In the claims, any means-plus-function clause is intended to cover the structures described herein as performing the recited function, and not only structural equivalents but also equivalent structures. Other substitutions, modifications, changes, and omissions may be made in the designs, operating conditions, and arrangements of the preferred embodiments without departing from the spirit of the invention as expressed in the appended claims.

What is claimed is:

1. A storage cabinet comprising:

a frame;

a drawer movable with respect to the frame; and a locking system including an input device having an output link movable along a path between a raised position and a lowered position, a lock blade providing a bottom perimeter and having an input end coupled to the output link of the input device, an output end and a fulcrum point along the bottom perimeter between the input end and the output end, the fulcrum point located external to the lock blade, a lockbar having an input end coupled to the output end of the lock blade and an output end, a first locking element associated with the output end of the lockbar, a second locking element associated with the drawer and adapted to be engaged by the first locking element;

so that when the input device drives the output link to the raised position, the input end of the lock blade is raised and the lock blade pivots about the fulcrum point so that the output end of the lock blade is lowered and the lockbar is lowered to disengage the first locking element from the second locking element, and when the input device drives the output link to the lowered position, the input end of the lock blade is lowered and the lock blade pivots about the fulcrum point so that the output end of the lock blade is raised and the lockbar is raised to engage the first locking element with the second locking element.

2. The storage cabinet of claim 1 wherein the input device includes a biasing element tending to drive the output link along the path from the raised position to the lowered position and from the lowered position to the raised position when an input motion is provided at the input device.

3. The storage cabinet of claim 2 wherein the output link is a lock pin and the biasing element is a tensioning member.

4. The storage cabinet of claim 1 wherein the lock blade is oriented in a substantially horizontal direction and the lockbar is oriented in a substantially vertical direction.

5. The storage cabinet of claim 1 wherein the first locking element is a projecting hook and the second locking element is a bracket into which the projecting hook is received when the first locking element engages the second locking element.

6. The storage cabinet of claim 3 wherein the tensioning member is a coil spring.

7. The storage cabinet of claim 1 wherein the lock blade includes a locking tab.

8. The storage cabinet of claim 7 wherein the input end of the lock blade includes a plurality of apertures, each aperture adapted for selective adjustable coupling to the output link of the input device.

9. The storage cabinet of claim 8 wherein the input end of the lockbar includes an aperture into which the output end of the lock blade is inserted.

10. The storage cabinet of claim 9 further comprising a pivot point associated with the frame about which the lock blade pivots at the fulcrum point.

11. A locking system for a storage cabinet having a frame and at least one drawer movable with respect to the frame, which comprises:

an input device;

a pair of coupling links, each coupling link having an input end coupled to the input device, an output end, and a fulcrum point located between the input end and the output end;

each coupling link having a first portion and a second portion with a positive angle at the fulcrum point between the first portion and the second portion;

a pair of lockbars, each lockbar having an input end coupled to the output end of the corresponding coupling link;

a pair of first locking elements, each first locking element coupled to the corresponding lockbar;

pair of second locking elements, each second locking element is mounted to the at least one drawer;

a pair of pivot points associated with the frame and with each coupling link;

so that when the input device is in an unlocked state, the input end of each coupling link is raised and each coupling link pivots at its fulcrum point about the corresponding pivot point so that the output end of each coupling link is lowered and the lockbar is lowered to disengage each first locking element from each second locking element and when the input device is in a locked state, the input end of each coupling link is lowered and each coupling link pivots at its fulcrum point about the corresponding pivot point so that the output end of each coupling link is raised and the lockbar is raised to engage each first locking element with each second locking element to secure the at least one drawer to the frame.

12. The locking system of claim 11 wherein the pair of coupling links is a pair of lock blades.

13. The locking system of claim 12 wherein one of the lock blades is longer than the other.

14. The locking system of claim 12 wherein each lock blade includes a stop.

15. The locking system of claim 12 wherein each lockbar is a channel.

16. The locking system of claim 12 wherein each lock blade has a plurality of apertures at the input end for linking the input device.

17. The locking system of claim 12 further comprising a stop on the frame.

18. The locking system of claim 11 wherein the input device is a lock mechanism with an output link and a biasing spring.

19. The locking system of claim 12 wherein each lock blade is oriented in a substantially horizontal direction and the lockbar is oriented in a substantially vertical direction.

20. The locking system of claim 14 wherein each first locking element is a projecting hook and each second locking element is a bracket into which the projecting hook is received.

21. A locking system for a storage unit having a frame and a drawer movable with respect to the frame, the locking system comprising:

an input device having an output link movable along a path between a raised position and a lowered position, a lock blade providing a bottom perimeter and having an input end coupled to the output link of the input device, an output end and a fulcrum point along the bottom perimeter between the input end and the output end, the fulcrum point located external to the lock blade, a lockbar having an input end coupled to the output end of the lock blade and an output end, a first locking element associated with the output end of the lockbar, a second locking element associated with the drawer and adapted to be engaged by the first locking element;

so that when the input device drives the output link to the raised position, the input end of the lock blade is raised and the lock blade pivots about the fulcrum point so that the output end of the lock blade is lowered and the lockbar is lowered to disengage the first locking element from the second locking element, and when the input device drives the output link to the lowered position, the input end of the lock blade is lowered and the lock blade pivots about the fulcrum point so that the output end of the lock blade is raised and the lockbar is raised to engage the first locking element with the second locking element.

22. The storage cabinet of claim 21 wherein the input device is a cylinder lock defining a first axis of movement for the output link and the lock blade pivots about a second axis generally defined by the fulcrum point, wherein the first axis is substantially parallel to the second axis.

* * * * *